US006209187B1

(12) United States Patent
Boeke

(10) Patent No.: US 6,209,187 B1
(45) Date of Patent: Apr. 3, 2001

(54) ROLLING TRAIN

(75) Inventor: Elmar Boeke, Hilchenbach (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/115,877

(22) Filed: Jul. 15, 1998

(30) Foreign Application Priority Data

Jul. 17, 1997 (DE) ..... 197 30 599

(51) Int. Cl.[7] ..... B21B 1/46
(52) U.S. Cl. ..... 29/527.7; 29/33 C; 164/476
(58) Field of Search ..... 29/527.7, 33 C; 164/417, 476

(56) References Cited

U.S. PATENT DOCUMENTS 5,115,547 * 5/1992 Rohde ..... 29/33 C
5,182,847 * 2/1993 Guse et al. ..... 29/527.7
5,305,515 * 4/1994 Fastert et al. ..... 29/527.7
5,560,095 * 10/1996 Kruger ..... 29/527.7

* cited by examiner

*Primary Examiner*—P. W. Echols
(74) *Attorney, Agent, or Firm*—Friedrich Kueffner

(57) ABSTRACT

A rolling train with a hot-rolling group, furnaces arranged upstream of the hot-rolling group and at least two continuous casting machines as well as cutting shears in front of and possibly behind the furnaces, wherein a furnace having a great length is provided for each continuous casting machine, the furnaces are constructed so as to be transversely displaceable, and the furnaces can be moved from the continuous casting lines into a common rolling line which deviates with respect to its location from the continuous casting lines, wherein the furnaces are divided in the longitudinal direction thereof into segments, and wherein the segments can be moved transversely individually and independently of each other.

10 Claims, 2 Drawing Sheets

ROLLING TRAIN

BACKGROUND OF THE INVENTION

1. Field of the Invention

The present invention relates to a rolling train with a hot-rolling group, furnaces arranged upstream of the hot-rolling group and at least two continuous casting machines as well as cutting shears in front of and possibly behind the furnaces.

2. Description of the Related Art

In rolling trains of the above-described type, the length of the furnaces is dimensioned in such a way that they are capable of receiving preliminary strips which have a length which corresponds essentially to the length of the coils to be formed. Generally, the first continuous casting machine and the corresponding furnace are arranged in line with the hot-rolling group and the second continuous casting machine and furnace group is arranged parallel offset relative to the first group. Through transverse conveyors in the second furnace or at the end of the otherwise stationary furnaces, the preliminary strip can be moved from the casting and furnace line of the second strand into the rolling line. Each time a preliminary strip has left one of the furnaces, it is necessary to thread or introduce a new preliminary strip from the other furnace into the hot-rolling group for the initial pass. This threading-in procedure constitutes an interruption of the stationary casting and rolling process and increases the risk of unproductive periods as a result of operation failures. In addition, an increased amount of scrap is produced at the respective strip beginning.

It has already been proposed to weld the beginning of the preliminary strip to the tail end of the preceding strip, so that a continuous rolling procedure is possible. However, for this purpose it is necessary to install expensive connecting devices. Large amounts of energy are required for connecting the preliminary strips.

SUMMARY OF THE INVENTION

Therefore, it is the primary object of the present invention to propose a rolling train in which threading-in procedures which are continuously repeated in short intervals are avoided, which does not require connecting procedures which are continuously repeated in short intervals and require large amounts of energy, and which makes it possible to essentially roll continuously.

In accordance with the present invention, a furnace having a great length is provided for each continuous casting machine, the furnaces are constructed so as to be transversely displaceable, and the furnaces can be moved from the continuous casting lines into a common rolling line which deviates with respect to its location from the continuous casting lines, wherein the furnaces are divided in the longitudinal direction thereof into segments, and wherein the segments can be moved transversely individually and independently of each other.

Each furnace having a great length is capable of receiving preliminary strips having lengths which, after cutting the strips, make it possible to form a plurality of finish-rolled coils. The transversely movable segments of each furnace make it possible that, after the preliminary strip has left partial areas of the furnace in the direction of the hot-rolling group, the segments can be pushed back into the casting line, so that the continuously operating casting machines do not have to be stopped.

The segments of the furnaces may have equal or different lengths, wherein the different lengths should be dimensioned in such a way that, for example, when using two casting machines and due to the fact that the feeding devices feed the strip into the rolling mill at an accelerated rate, the length of the segments should double from segment to segment toward the hot-rolling group. When three casting lines are used, the speed of the feeding devices would approximately correspond to three times the casting speed, so that the lengths of the segments could triple from segment to segment.

In accordance with an advantageous feature, the segment of each furnace adjacent the casting machine is stationary. After the preliminary strip has been cut by means of the cutting shears, this stationary furnace segment can be quickly emptied by means of the feeding device, so that the stationary segments can be used as buffers while the displaceable segments are located in the rolling line. A corresponding application is also intended for the stationary furnace segment in front of the hot-rolling group.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
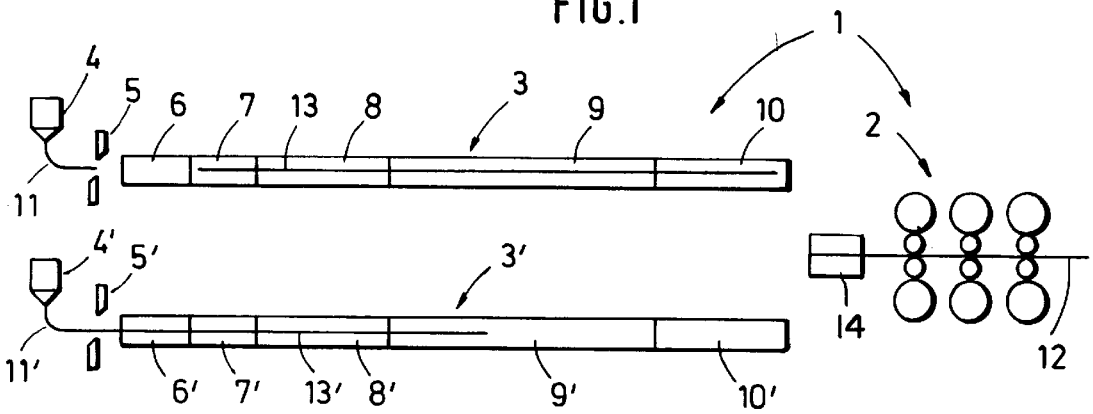
FIGS. 1–6 are schematic illustrations of the rolling train according to the present invention shown in different phases of the transport of the preliminary strip.

FIGS. 1–6 of the drawing show a rolling train 1 composed of a hot-rolling group 2, two furnaces 3, 3' and two casting machines 4, 4'. Shears 5, 5' are arranged between the casting machines 4, 4' and the furnaces 3, 3'.

The furnaces 3, 3' have stationary segments 6, 6', while the segments 7, 7', 8, 8', 9, 9' and 10, 10' can be moved from the casting line 11, 11' into the rolling line 12. Another stationary furnace segment 14 is arranged in the rolling line 12 in front of the hot-rolling group 2.

FIG. 1 shows the preliminary strip 13 immediately after a cut was made by the shears 5. A feeding device, not shown, has pulled the preliminary strip from the stationary furnace segment 6 into the furnace segments 7, 8, 9 and 10. The preliminary strip 13' in the second casting line 11' approximately fills out half of the furnace 3'.

Figure 2:
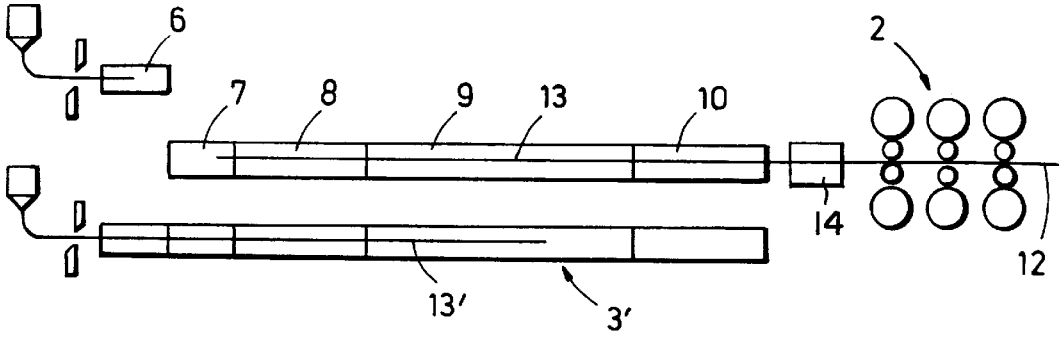

As shown in FIG. 2, the segments 7, 8, 9, 10 have been pushed into the rolling line 12. The preliminary strip 13 has been threaded into the hot-rolling group 2 and is being hot-rolled. The length of the preliminary strip 13' increases in the furnace 3'.

Figure 3:
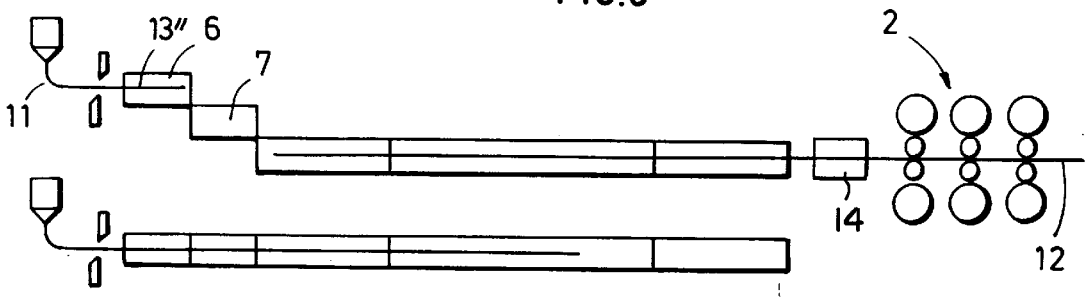

FIG. 3 shows that the stationary segment 6 which serves as a buffer has been almost completely filled with preliminary strip 13". The preliminary strip 13 has already been pulled out of the segment 7. The segment 7 is being pushed back into the casting line 11.

Figure 4:
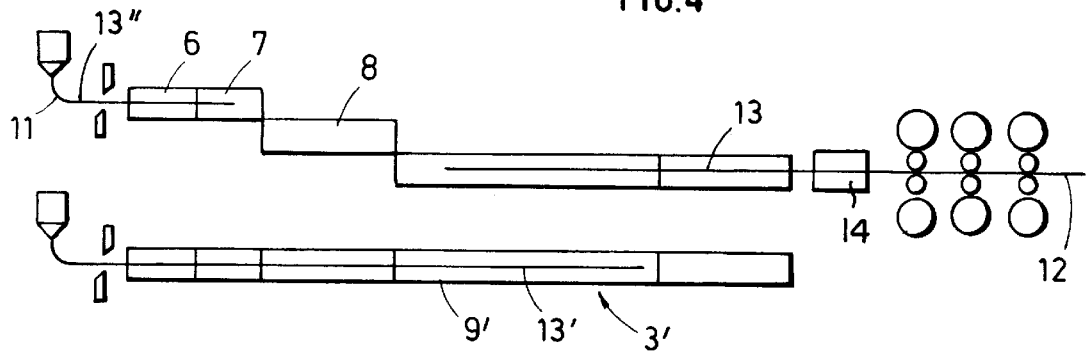

FIG. 4 shows the displaceable segment 7 after it has been returned into the casting line 11 and the stationary furnace segment 6 is already filled with preliminary strip 13". The displaceable segment 7 is filled up to half its length. The preliminary strip 13 has already left the displaceable segment 8 which is being pushed back into the casting line 11. The preliminary strip 13' is being pushed further into the furnace 3'. The segment 9' is almost completely filled with the preliminary strip 13'.

Figure 5:
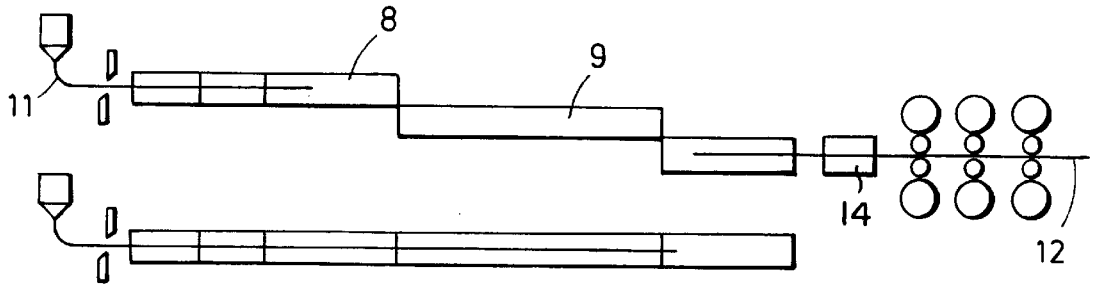

FIG. 5 shows that the displaceable segment 8 has been pushed back into the casting line 11. The displaceable segment 9 is on its way from the rolling line 12 to the casting line 11.

Figure 6:
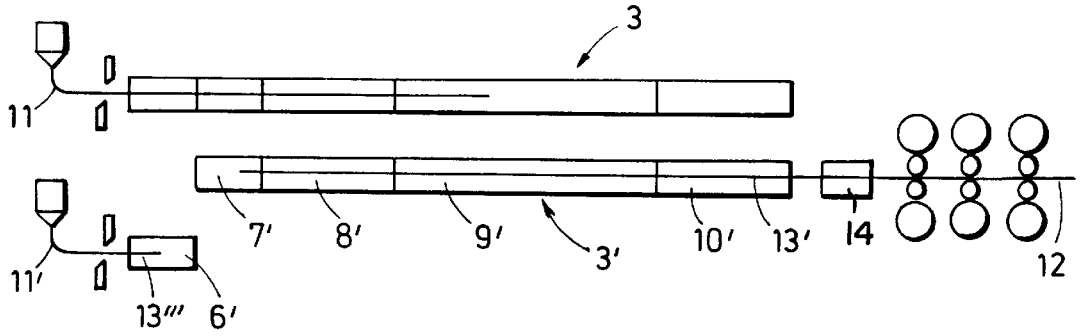

As shown in FIG. 6, the complete furnace 3 has once again been pushed back into the casting line 11 and the furnace 3' is now in the rolling line 12. The stationary segment 6' which serves as a buffer element is already filled with preliminary strip 13'''. After the preliminary strip 13' has left the furnace 3', the segments 7', 8', 9' and 10' can be successively pushed back into the casting line 11'.

The invention is not limited by the embodiments described above which are presented as examples only but can be modified in various ways within the scope of protection defined by the appended patent claims.

I claim:

1. A rolling train comprising a hot-rolling group located in a rolling line, at least two continuous casting machines located in continuous casting lines arranged offset relative to the rolling line, a furnace being provided for each continuous casting machine, the furnaces being located upstream of the hot-rolling group, and shears arranged upstream of each furnace, the furnaces being configured to be displaceable transversely between the continuous casting lines and the rolling line, and wherein each furnace is divided in a longitudinal direction thereof into segments, and wherein the segments are configured to be displaceable individually and independently of each other.

2. The rolling train according to claim 1, wherein each furnace has a length dimension adapted such that the furnace can receive rolling stock in a length corresponding to several coils.

3. The rolling train according to claim 1, wherein the segments of each furnace are of equal length.

4. The rolling train according to claim 1, wherein the segments of each furnace are of different lengths.

5. The rolling train according to claim 4, wherein the lengths of the segments increase toward the hot-rolling group.

6. The rolling train according to claim 1, wherein each furnace has a stationary segment adjacent to the continuous casting machine.

7. The rolling train according to claim 1, wherein each furnace comprises a feeding device for rolling stock for accelerating the rolling stock and feeding the rolling stock into the hot-rolling group.

8. The rolling train according to claim 1, further comprising a stationary furnace segment arranged in the rolling line upstream of the hot-rolling group.

9. A method of operating a rolling train including a hot-rolling group located in a rolling line, at least two continuous casting machines located in continuous casting lines arranged offset relative to the rolling line, a furnace being provided for each continuous casting machine, the furnaces being located upstream of the hot-rolling group, and shears arranged upstream of each furnace, the furnaces being configured to be displaceable transversely between the continuous casting lines and the rolling line, and wherein each furnace is divided in a longitudinal direction thereof into segments, and wherein the segments are configured to be displaceable individually and independently of each other, the method comprising introducing a preliminary strip produced by one of the continuous casting machines with a casting speed into the corresponding furnace, wherein the individual segments of the corresponding furnace have previously been moved successively into the continuous casting line, actuating the shears in front of the corresponding furnace at the latest after a predetermined maximum length of the preliminary strip has been introduced into the furnace and accelerating the preliminary strip after cutting at a speed greater than the casting speed, moving the segments in alignment with each other into the rolling line, pulling the preliminary strip from the furnace toward an initial pass in the hot-rolling group, and successively returning the segments of the furnace from which the preliminary strip has been removed into the casting line.

10. The method according to claim 9, comprising operating the shears and the furnace of a second of the casting machines alternatingly with the shears and the furnace of the first casting machine.

* * * * *